US011183345B2

(12) United States Patent
Liang et al.

(10) Patent No.: US 11,183,345 B2
(45) **Date of Patent: *Nov. 23, 2021**

(54) KEYSWITCH WITH SUPPORTING MECHANISM

(71) Applicant: LITE-ON Technology (Chang Zhou) Co., LTD., Jiangsu Province (CN)

(72) Inventors: XiaoQiang Liang, Jiangsu Province (CN); Lei Shi, Jiangsu Province (CN); XueLei Liu, Jiangsu Province (CN)

(73) Assignee: LITE-ON Technology (Chang Zhou) Co., LTD., Jiangsu Province (CN)

( * ) Notice: Subject to any disclaimer, the term of this patent is extended or adjusted under 35 U.S.C. 154(b) by 0 days.

This patent is subject to a terminal disclaimer.

(21) Appl. No.: 17/096,250

(22) Filed: Nov. 12, 2020

(65) Prior Publication Data

US 2021/0065998 A1 Mar. 4, 2021

Related U.S. Application Data

(63) Continuation-in-part of application No. 16/796,835, filed on Feb. 20, 2020, now Pat. No. 10,867,761.

(30) Foreign Application Priority Data

Jul. 29, 2019 (CN) ..... 201910688739.9

(51) Int. Cl.
*H01H 3/12* (2006.01)
*H01H 13/7065* (2006.01)

(52) U.S. Cl.
CPC ..... *H01H 3/125* (2013.01); *H01H 13/7065* (2013.01)

(58) Field of Classification Search
CPC ..... H01H 3/125; H01H 13/705; H01H 13/14; H01H 13/70; H01H 13/704;
(Continued)

(56) References Cited

U.S. PATENT DOCUMENTS 5,562,203 A 10/1996 Mochizuki
7,385,149 B2 6/2008 Liu
(Continued)

FOREIGN PATENT DOCUMENTS

CN 107492462 A 12/2017

*Primary Examiner* — Ahmed M Saeed
(74) *Attorney, Agent, or Firm* — Umberg Zipser LLP; Ryan Dean

(57) ABSTRACT

The present disclosure discloses a keyswitch with supporting mechanism. The keyswitch comprising a supporting mechanism disposed between the keycap and the baseplate, wherein the keycap is able to move up and down relative to the baseplate, wherein the supporting mechanism comprises a first supporting element, on which two opposite first side surfaces respectively comprise a first connecting part; and a second supporting element, on which two opposite second side surfaces respectively comprise a second connecting part, the first connecting parts are pivotally connected to the corresponding second connecting parts, wherein two protrusions are respectively disposed on each of the two first side surfaces of the first supporting element, two smooth surfaces are respectively formed on each of the two protrusions, and the first connecting parts are respectively disposed on each of the two protrusions.

16 Claims, 13 Drawing Sheets

(58) Field of Classification Search
CPC ..... H01H 13/7065; H01H 13/7006; H01H 13/7057; H01H 13/78; H01H 13/79; H01H 13/52; H01H 13/703; H01H 13/507
See application file for complete search history.

(56) References Cited

U.S. PATENT DOCUMENTS

| | | | | |
|---|---|---|---|---|
| 2017/0191612 | A1* | 7/2017 | Yen | F16M 13/02 |
| 2018/0075987 | A1 | 3/2018 | Tsai et al. | |
| 2018/0269011 | A1* | 9/2018 | Zhang | H01H 13/7073 |
| 2018/0358193 | A1 | 12/2018 | Chen et al. | |

* cited by examiner

KEYSWITCH WITH SUPPORTING MECHANISM

CROSS REFERENCE TO RELATED APPLICATION

This application is a continuation in part of U.S. patent application Ser. No. 16/796,835, filed Feb. 20, 2020, which claims the benefit of U.S. claims the priority benefit of Chinese Patent Application Serial Number CN201910688739.9, filed on Jul. 29, 2019, each of which is incorporated by reference herein in its entirety.

BACKGROUND

Technical Field

The present disclosure relates to the technical field of keyswitches, and more particularly to a keyswitch with the supporting mechanism.

Related Art

The supporting mechanism is one of the common supporting devices for supporting and positioning a keycap in a keyswitch for a computer keyboard. A first supporting element pivotally connected to a second supporting element constitutes a supporting mechanism. They will pivot relative to each other when the keyswitch is being pressed or released.

SUMMARY

The present disclosure provides a keyswitch to solve the noise from the rubbing of the contacting surfaces of a first supporting element and a second supporting element within the mechanism when pivoting.

One embodiment provides a keyswitch comprising a baseplate, a keycap disposed on the baseplate; and a supporting mechanism disposed between the keycap and the baseplate, wherein the top end of the supporting mechanism connects to the keycap, and the bottom end of the supporting mechanism connects to the baseplate such that the keycap is able to move up and down relative to the baseplate, wherein the supporting mechanism comprises a first supporting element, on which two opposite first side surfaces respectively comprise a first connecting part; and a second supporting element, on which two opposite second side surfaces respectively comprise a second connecting part, the first connecting parts are pivotally connected to the corresponding second connecting parts, wherein two protrusions are respectively disposed on each of the two first side surfaces of the first supporting element, two smooth surfaces are respectively formed on each of the two protrusions, and the first connecting parts are respectively disposed on each of the two protrusions.

A keyswitch comprising a baseplate, a keycap disposed on the baseplate, a supporting mechanism disposed between the keycap and the baseplate, wherein the top end of the supporting mechanism connects to the keycap, and the bottom end of the supporting mechanism connects to the baseplate such that the keycap is able to move up and down relative to the baseplate, wherein the supporting mechanism comprises a first supporting element, on which two opposite first side surfaces respectively comprise a first connecting part; and a second supporting element, on which two opposite second side surfaces respectively comprise a second connecting part, the first connecting parts are pivotally connected to the corresponding second connecting parts, wherein two protrusions are respectively disposed on each of the two second side surfaces of the second supporting element, two smooth surfaces are respectively formed on each of the two protrusions, and the second connecting parts are respectively disposed on each of the two protrusion.

The noise from the pivotally rubbing of the first supporting element and the second supporting element of the supporting mechanism of the present disclosure might be reduced by the smooth surface disposed between the supporting elements.

It should be understood, however, that this summary may not contain all aspects and embodiments of the present invention, that this summary is not meant to be limiting or restrictive in any manner, and that the invention as disclosed herein will be understood by one of ordinary skill in the art to encompass obvious improvements and modifications thereto.

BRIEF DESCRIPTION OF THE DRAWINGS

The features of the exemplary embodiments believed to be novel and the elements and/or the steps characteristic of the exemplary embodiments are set forth with particularity in the appended claims. The Figures are for illustration purposes only and are not drawn to scale. The exemplary embodiments, both as to organization and method of operation, may best be understood by reference to the detailed description which follows taken in conjunction with the accompanying drawings in which:

DETAILED DESCRIPTION OF THE EMBODIMENTS

Figure 1:
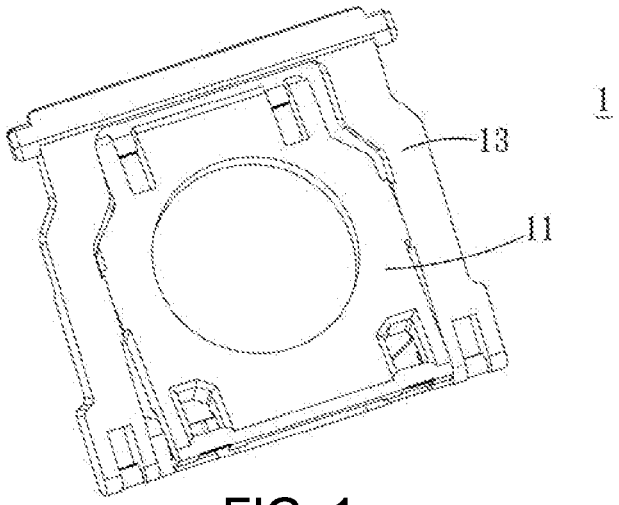
FIG. 1 is a perspective view of the first embodiment of the supporting mechanism of the present disclosure.

The present invention will now be described more fully hereinafter with reference to the accompanying drawings, in which exemplary embodiments of the invention are shown. This present invention may, however, be embodied in many different forms and should not be construed as limited to the embodiments set forth herein. Rather, these embodiments are provided so that this present invention will be thorough and complete, and will fully convey the scope of the present invention to those skilled in the art.

Certain terms are used throughout the description and following claims to refer to particular components. As one skilled in the art will appreciate, manufacturers may refer to a component by different names. This document does not intend to distinguish between components that differ in name but function. In the following description and in the claims, the terms "include/including" and "comprise/comprising" are used in an open-ended fashion, and thus should be interpreted as "including but not limited to". "Substantial/substantially" means, within an acceptable error range, the person skilled in the art may solve the technical problem in a certain error range to achieve the basic technical effect.

The following description is of the best-contemplated mode of carrying out the invention. This description is made for the purpose of illustration of the general principles of the invention and should not be taken in a limiting sense. The scope of the invention is best determined by reference to the appended claims.

Moreover, the terms "include", "contain", and any variation thereof are intended to cover a non-exclusive inclusion. Therefore, a process, method, object, or device that includes a series of elements not only include these elements, but also includes other elements not specified expressly, or may include inherent elements of the process, method, object, or device. If no more limitations are made, an element limited by "include a/an . . . " does not exclude other same elements existing in the process, the method, the article, or the device which includes the element.

In the following embodiment, the same reference numerals are used to refer to the same or similar elements throughout the invention.

Figure 2:
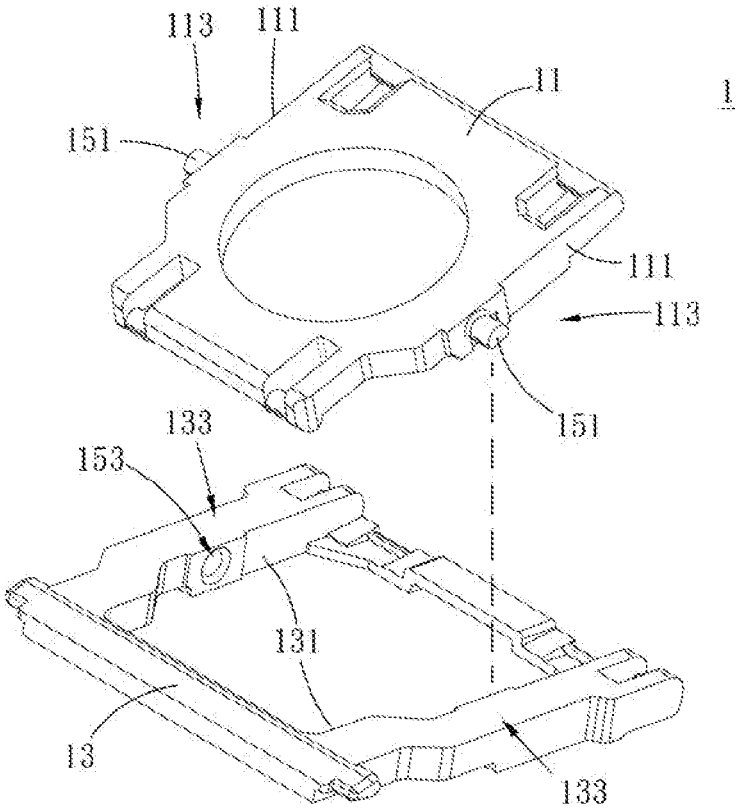
FIG. 2 is an exploded view of the first embodiment of the supporting mechanism of the present disclosure.

FIG. 1 and FIG. 2 are a perspective view and an exploded view of the first embodiment of the supporting mechanism of the present disclosure. The present disclosure provides a supporting mechanism 1 disposed between the baseplate and keycap which is a support for lifting inside a keyswitch. The supporting mechanism 1 comprises a first supporting element 11 and an second supporting element 13.

Figure 3:
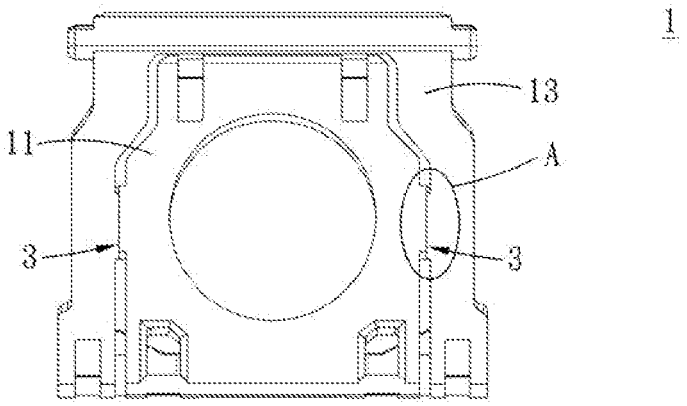
FIG. 3 is a side view of the first embodiment of the supporting mechanism of the present disclosure.
Figure 4:
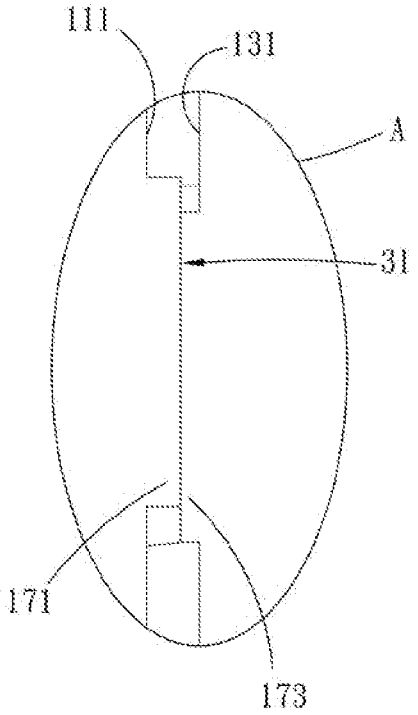
FIG. 4 is an enlarged view of area A of FIG. 3.

FIG. 3 is a side view of the first embodiment of the supporting mechanism of the present disclosure and FIG. 4 is an enlarged view of area A of FIG. 3. In the present embodiment, two opposite first side surfaces III of the first supporting element 11 respectively comprise a first connecting part 113, and two opposite second side surfaces 131 of the second supporting element 13 respectively comprise a second connecting part 133. The first supporting element 11 is disposed within the second supporting element 13, and the first connecting part 113 is pivotally connected to the corresponding second connecting part 133. An anti-frictional configuration 3 is disposed between each of the two first side surfaces 111 of the first supporting element 11 and each of the two second side surfaces 131 of the second supporting element 13 corresponding to each of the first side surfaces 111 of the first supporting element 11. The anti-frictional configuration 3 is provided with a smooth surface 31, and the smooth surface 31 is a flat surface or an arc surface. The first supporting element 11 and the second supporting element 13 are relatively pivoted. When the first side surfaces 111 of the first supporting element 11 and the second side surfaces 131 of the second supporting element 13 contact and rub with each other, the smooth surface 31 can reduce the noise generated by friction.

The first supporting element 11 and the second supporting element 13 are demolded by angle lifting demolding to change the position of the parting line or the burr from demolding, producing smooth surfaces 31 between the first supporting element 11 and the second supporting element, so that the two first side surfaces 111 and the two second side surfaces 131 are free from any parting lines or burrs. The means described above reduces or eliminates the parting lines or burrs from two first side surfaces 11 of the first supporting element 11 and two second side surfaces 131 of the second supporting element 13. In this embodiment, the smooth surface 31 of the first side surfaces 111 or the second side surfaces 131 is smoother than other surfaces that have not been molded by angle lifting demolding.

Figure 5:
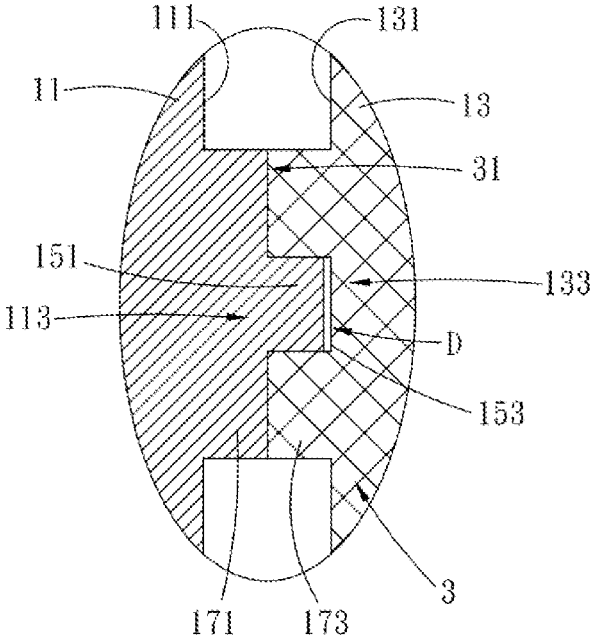
FIG. 5 is a sectional view of the first embodiment of the supporting mechanism of the present disclosure.

FIG. 5 is a sectional view of FIG. 4 and the first embodiment of the supporting mechanism of the present disclosure. In the present embodiment, each of the two anti-frictional configurations 3 comprises a first protrusion 171 and a second protrusion 173. A first protrusion 171 is disposed on each of the two first side surfaces 111, and a second protrusion 173 is disposed on each of the two second side surfaces 131. A first connecting part 113 is disposed on each of the two first protrusions 171, and a second connecting part 133 is disposed on each of the two second protrusions 173. A smooth surface 31 is provided between each of two first protrusions 171 and each of two second protrusions 173 corresponding to each of the two first protrusions 171. Each of two first connecting part 113 is a shaft 151, and each of two second connecting part 133 is a shaft hole 153. Each of two shafts 151 and each of two shaft holes 153 is pivotally connected. In the present embodiment, in addition to eliminate the noise from rubbing by the two smooth surfaces 31 disposed between each of the two first protrusions 171 and each of the two second protrusions 173 corresponding to each of the two first protrusions 171, the relative arrangement of each of the two first protrusions 171 and each of the two second protrusions 173 corresponding to each of the two first protrusions 171 can also reduce the size of the contact area between each of the two first side surfaces 111 of the first supporting element 11 and each of the second side surfaces 131 corresponding to each of the two first side surfaces 111 of the second supporting element 13. That is, the rubbing noise is eliminated by effectively reducing the size of the contact surface between the first supporting element 11 and the second supporting element 13.

Therefore, each of the two first connecting part 113 of the first supporting element 11 is a shaft 151 and each of the two second connecting part 133 of the second supporting element 13 is a shaft hole 153. Each of the two shafts 151 and each of the two shaft holes 153 corresponding to each of the two shafts 151 are pivotally connected. Each of the two second connecting part 133 is a shaft hole 153 if each of the two first connecting part 133 is a shaft 151. Each of the two connecting part 133 is a shaft 151 if each of the two first connecting part 133 is a shaft hole 153. The present disclosure does not limit the positional interchange between a shaft 151 and a corresponding shaft hole 153.

Moreover, a gap D (referring to FIG. 5) exists between the end surface of each of the two shafts 151 and a surface of the shaft hole corresponding to each of the two shafts 151 perpendiculars to the axis of each of the two shafts 151, and the gap D is less than or equal to 0.1 mm. Namely, the shape of the shaft hole 153 adapts to the shaft 151 passing through the shaft hole 153. The gap between the end surface of each of the two shafts 151 and the bottom surface of each of the two shaft holes 153 corresponding to each of the two shafts 151 is 0.1 mm or less. Limiting the gap between the end surface of each of the two shafts 151 and the bottom surface of each of the two shaft holes 153 corresponding to each of the two shafts 151 can reduce the rocking of the first supporting element 11 and the second supporting element 13 when the first supporting element 11 is combined with the second supporting element 13. In the present embodiment, the gap between the first supporting element 11 and the second supporting element 13 can properly reduced to eliminate the rocking when the supporting mechanism made of first supporting element 11 and the second supporting element 13 is actuated.

Figure 6:
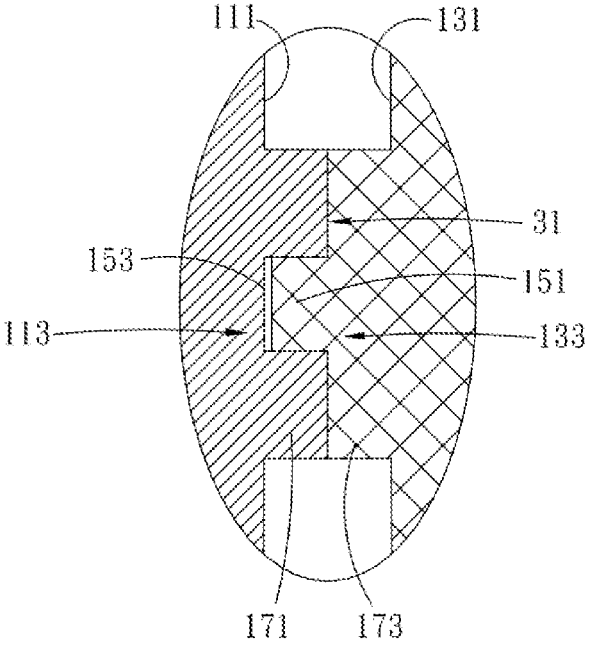
FIG. 6 is a sectional view of the second embodiment of the supporting mechanism of the present disclosure.

FIG. 6 is a sectional view of the second embodiment of the supporting mechanism of the present disclosure. The present embodiment differs from the first embodiment upon the position where the two shafts 151 and the two shaft holes 153 are disposed. In the present embodiment, each of the two shafts 151 is disposed on each of the two second protrusions 173 corresponding to each of the two shafts 151, and each of the two shaft holes 153 is disposed on each of the two first protrusions 171 corresponding to each of the two shaft holes 153. Each of the two shafts 151 is pivotally connected to each of the two shaft holes 153 corresponding to each of the two shafts 151.

Figure 7:
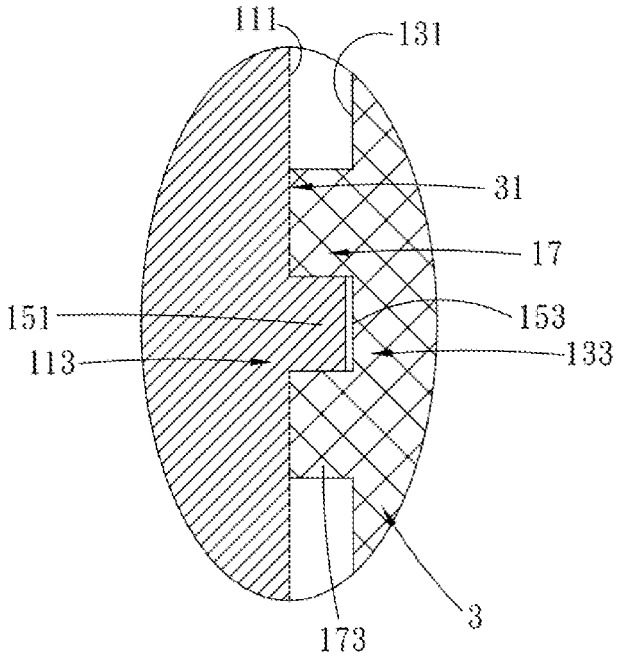
FIG. 7 is a sectional view of the third embodiment of the supporting mechanism of the present disclosure.

FIG. 7 is a sectional view of the third embodiment of the supporting mechanism of the present disclosure. The present embodiment differs from the first embodiment in that a protrusion is only disposed on one side surface. Each of the anti-frictional configuration 3 comprises a protrusion 17 disposed on each of the first side surfaces 111 or on each of the two second side surfaces 131. On the end surface of a protrusion 17 a smooth surface 31 is comprised. Each of the two first connecting part 113 or each of the two second connecting part 133 is disposed on the protrusion 17. In the present embodiment, each of the two second side surfaces 131 comprises a second protrusion 173. A shaft 151 is disposed on each of the two first side surfaces 111, and a shaft hole 153 is disposed on a second protrusion 173 of each of the two second side surfaces 131. Each of the two shafts 151 is pivotally connected to a shaft hole 153 corresponding to the shaft 151. A smooth surface 31 is provided between the end surface of each of the second protrusions 173 and each of the two fisrt side surfaces 11 contacting with the end surface of each of the second protrusions 173.

Figure 8:
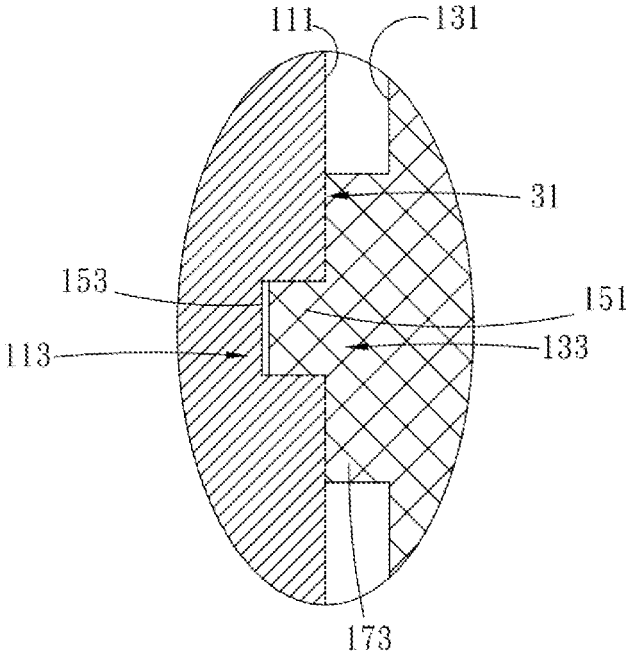
FIG. 8 is a sectional view of the fourth embodiment of the supporting mechanism of the present disclosure.

FIG. 8 is a sectional view of the fourth embodiment of the supporting mechanism of the present disclosure. The present embodiment differs from the third embodiment upon the position where the two shafts 151 and the two shaft holes 153 are disposed. In the present embodiment, a shaft hole 153 is disposed on each of the two first side surfaces 111, and a shaft 151 is disposed on a second protrusion 173 of each of the two second side surfaces 131. Each of the two shafts 151 is pivotally connected to each of the two shaft holes 153 corresponding to each of the two shafts 151.

Figure 9:
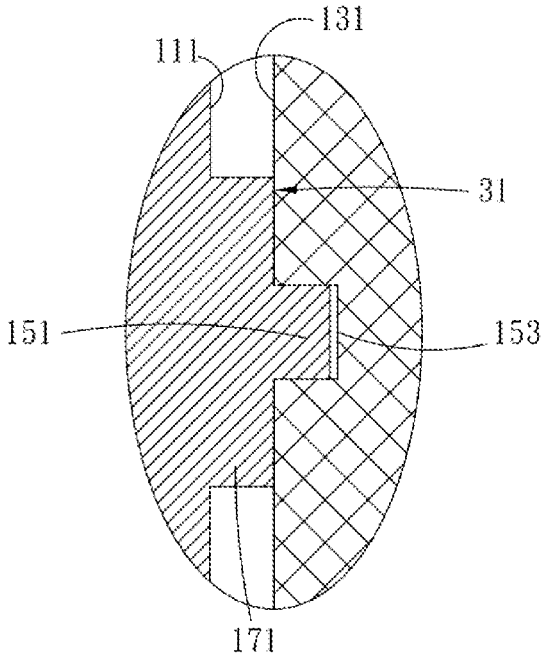
FIG. 9 is a sectional view of the fifth embodiment of the supporting mechanism of the present disclosure.

FIG. 9 is a sectional view of the fifth embodiment of the supporting mechanism of the present disclosure. The present embodiment differs from the first embodiment upon the position of protrusions. In the present embodiment, each of the first side surfaces 111 comprises a first protrusion 171, and a shaft 151 is disposed on a first protrusion 171 of each of the two first side surfaces 111. A shaft hole 153 is disposed on each of the two second side surfaces 131, and each of the two shafts 151 is pivotally connected to each of the two shaft holes 153 corresponding to each of the two shafts 151. A smooth surface 31 is provided in between the end surface of each of the first protrusions 171 and each of the two second side surfaces 131 contacting with the end surface of each of the first protrusions 171.

Figure 10:
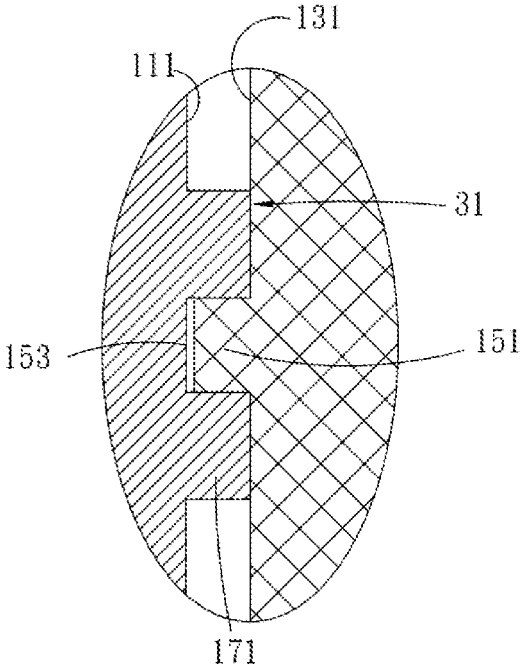
FIG. 10 is a sectional view of the sixth embodiment of the supporting mechanism of the present disclosure.

FIG. 10 is a sectional view of the sixth embodiment of the supporting mechanism of the present disclosure. The present embodiment differs from the fifth embodiment upon the position where the two shafts 151 and the two shaft holes 153 are disposed. In the present embodiment, a shaft hole 153 is disposed on a first protrusion 171 of each of the two first side surfaces 111, and a shaft 151 is disposed on each of the two second side surfaces 131. Each of the two shafts 151 is pivotally connected to each of the two shaft holes 153 corresponding to each of the two shafts 151.

Figure 11:
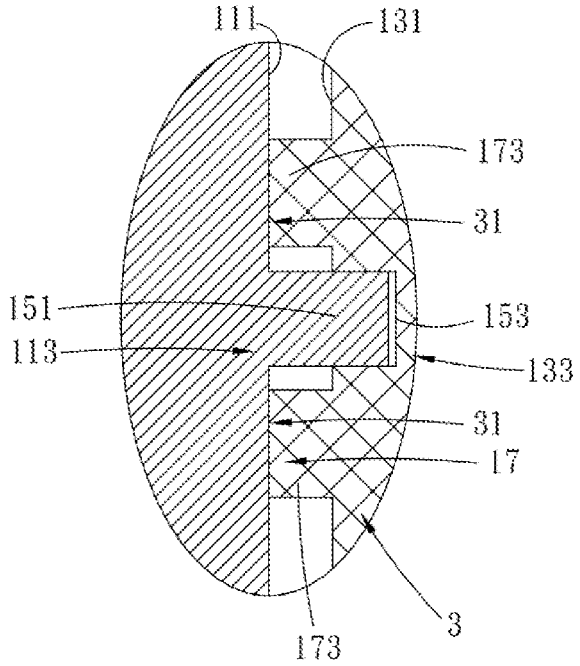
FIG. 11 is a sectional view of the seventh embodiment of the supporting mechanism of the present disclosure.

FIG. 11 is a sectional view of the seventh embodiment of the supporting mechanism of the present disclosure. The present embodiment differs from the third embodiment upon the position where the two shafts 151 and the two shaft holes 153 are disposed. Each of the anti-frictional configuration 3 comprises a protrusion 17 disposed on each of the two first side surfaces 111 or on each of the two second side surfaces 131. On the end surface of a protrusion 17 is a smooth surface 31. A first connecting part 113 or a second connecting part 133 is disposed on one side of a protrusion 17, in which the quantity of protrusion 17 can be one or more than one. In the present embodiment, each of the two second side surfaces 131 comprises two second protrusions 173. A shaft 151 is disposed on each of the two first side surfaces 111, and a shaft hole 153 is disposed between two second protrusions 173 of each of the two second side surface 131 corresponding to each of the two first side surfaces 111. Each of the two shafts 151 is pivotally connected to each of the two shaft holes 153 corresponding to each of the two shafts 151. A smooth surface 31 is provided between the end surface of two second protrusions 173 and each of the two first side surfaces 111 contacting with the end surface of two second protrusions 173. The two second protrusions 173 can simultaneously stabilize the rocking of the first supporting element 11 and the second supporting element 13.

Figure 12:
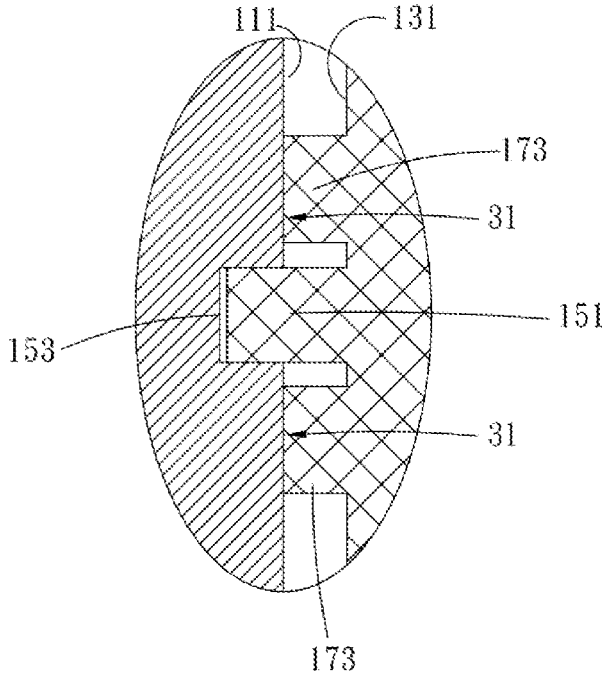
FIG. 12 is a sectional view of the eighth embodiment of the supporting mechanism of the present disclosure.

FIG. 12 is a sectional view of the eighth embodiment of the supporting mechanism of the present disclosure. The present embodiment differs from the seventh embodiment upon the position where the two shafts 151 and the two shaft holes 153 are disposed. In the present embodiment, a shaft hole 153 is disposed on each of the two first side surfaces 111, and a shaft 151 is disposed between two second protrusions 173 of each of the two second side surfaces 131 corresponding to each of the two first side surfaces 111. Each of the two shafts 151 is pivotally connected to each of the two shaft holes 153 corresponding to each of the two shafts 151.

Figure 13:
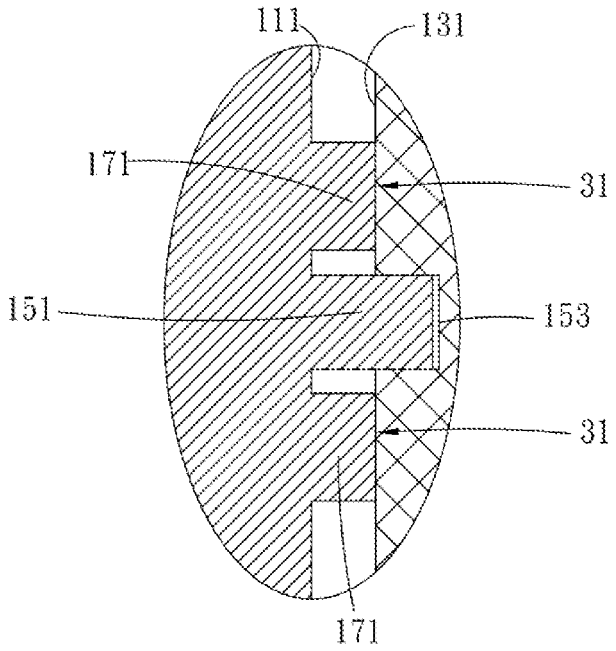
FIG. 13 is a sectional view of the ninth embodiment of the supporting mechanism of the present disclosure.

FIG. 13 is a sectional view of the ninth embodiment of the supporting mechanism of the present disclosure. The present embodiment differs from the seventh embodiment upon the position of protrusions. In the present embodiment, each of the two first side surfaces 111 comprises two first protrusions 171. A shaft 151 is disposed between two first protrusions 171 of each of the two first side surfaces 111, and a shaft hole 153 is disposed on each of the two second side surfaces 131. Each of the two shafts 151 is pivotally connected to each of the two shaft holes 153 corresponding to each of the two shafts 151. A smooth surface 31 is provided in between the end surface of two first protrusions 171 and each of the two second side surfaces 131 contacting with the end surface of two first protrusions 171. The two first protrusions 171 can simultaneously stabilize the rocking of the first supporting element 11 and the second supporting element 13.

Figure 14:
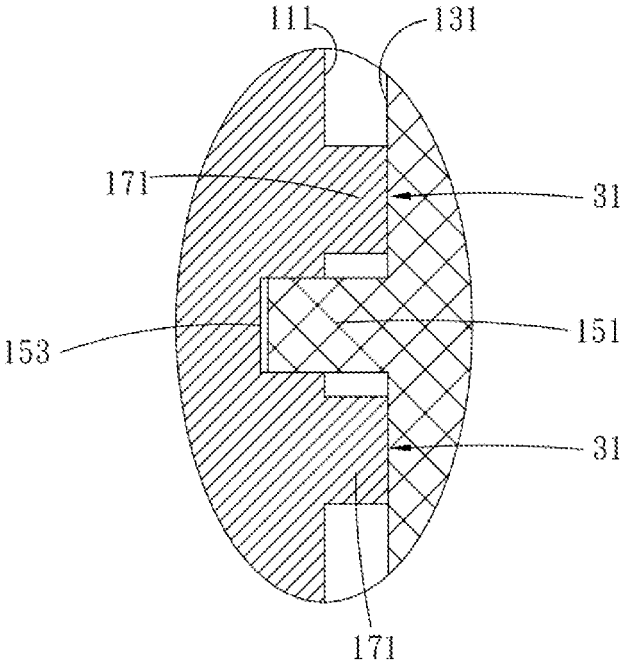
FIG. 14 is a sectional view of the tenth embodiment of the supporting mechanism of the present disclosure.

FIG. 14 is a sectional view of the tenth embodiment of the supporting mechanism of the present disclosure. The present embodiment differs from the ninth embodiment upon the position where the two shafts 151 and the two shaft holes 153 are disposed. In the present embodiment, a shaft hole 153 is disposed between two protrusions 17 of each of the two first side surfaces 111, and a shaft 151 is disposed on each of the two second side surfaces 131 corresponding to each of the two first side surfaces 111. Each of the two shafts 151 is pivotally connected to each of the two shaft holes 153 corresponding to each of the two shafts 151.

Figure 15:
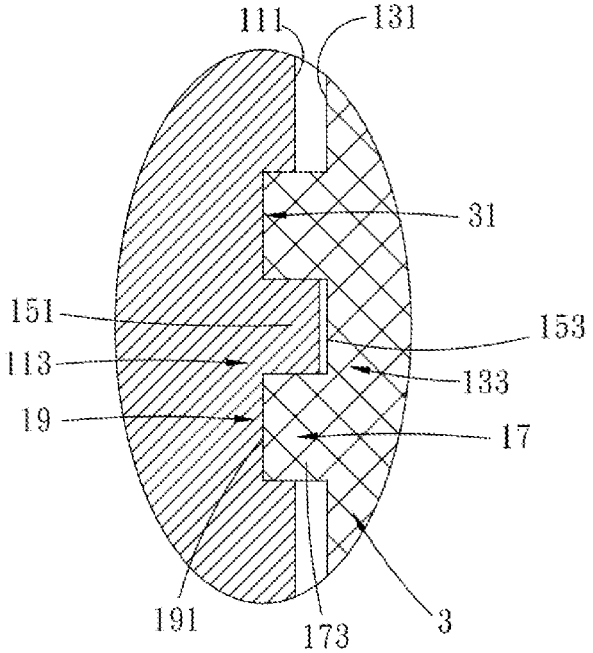
FIG. 15 is a sectional view of the eleventh embodiment of the supporting mechanism of the present disclosure.

FIG. 15 is a sectional view of the eleventh embodiment of the supporting mechanism of the present disclosure. The present embodiment differs from the third embodiment in the existing of two recesses 19 and two protrusions 17. Each of the anti-frictional configuration 3 comprises a recess 19 and a protrusion 17 disposed in the recess 19. A smooth surface 31 is provided in between each of the two recesses 19 and each of the two protrusions 17 corresponding to each of the two recesses 19. A recess 19 is disposed on each of the two first side surfaces 111, and a protrusion 17 is disposed on each of the two second side surfaces 131 corresponding to each of the two first side surfaces 111. A first connecting part 113 is disposed on each of the two protrusions 17, and a second connecting part 133 is disposed on each of the two recesses 19 corresponding to each of the two protrusions 17. In the present embodiment, each of the two first side surfaces 111 comprises a first recess 191, and each of the two second side surfaces 131 comprises a second protrusion 173. A shaft 151 is disposed in a first recess 191 of each of the two first side surfaces 111, and a shaft hole 153 is disposed on a second protrusion 173 of each of the two second side surfaces 131 corresponding to each of the two first side surfaces 111. Each of the two shafts 151 is pivotally connected to each of the two shaft holes 153 corresponding to each of the two shafts 151. The bottom surface of each of the two recesses 19 is a flat surface, and a smooth surface 31 is provided in between an outer surface of each of the two protrusions 17 and an inner surface of each of the two recesses 19.

Figure 16:
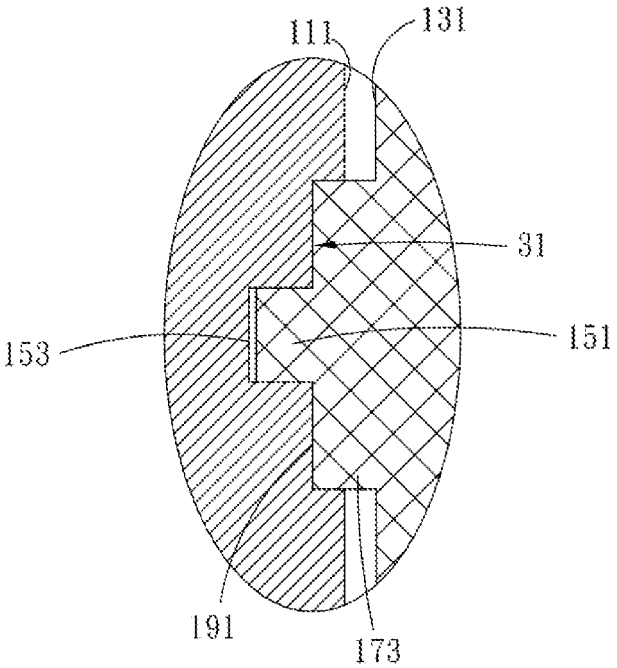
FIG. 16 is a sectional view of the twelfth embodiment of the supporting mechanism of the present disclosure.

FIG. 16 is a sectional view of the twelfth embodiment of the supporting mechanism of the present disclosure. The present embodiment differs from the eleventh embodiment upon the position where the two shafts 151 and the two shaft holes 153 are disposed. In the present embodiment, a shaft hole 153 is disposed in a first recess 191 of each of the two first side surfaces 111, and a shaft 151 is disposed on a second protrusion 173 of each of the two second side surfaces 131. Each of the two shafts 151 is pivotally connected to each of the two shaft holes 153 corresponding to each of the two shafts 151.

Figure 17:
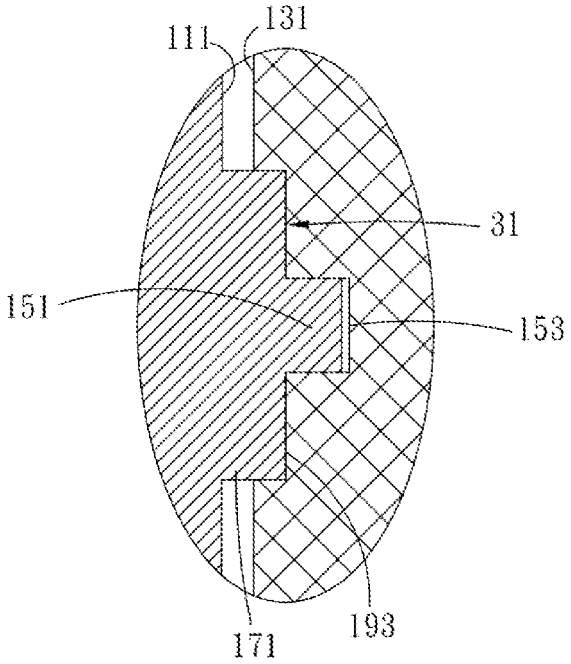
FIG. 17 is a sectional view of the thirteenth embodiment of the supporting mechanism of the present disclosure.

FIG. 17 is a sectional view of the thirteenth embodiment of the supporting mechanism of the present disclosure. The present embodiment differs from the eleventh embodiment in the position where the two recesses 19 and the two protrusions 17 are disposed. In the present embodiment, each of the two first side surfaces 111 comprises a first protrusion 171, and each of the two second side surfaces 131 comprises a second recess 193. A shaft 151 is disposed on a first protrusion 171 of each of the two first side surfaces 111, and a shaft hole 153 is disposed in a second recess 193 of each of the two second side surfaces 131. Each of the two shafts 151 is pivotally connected to each of the two shaft holes 153 corresponding to each of the two shafts 151, and a smooth surface 31 is provided in between an outer surface of each of the two first protrusions 171 and an inner surface of each of the two second recesses 193.

Figure 18:
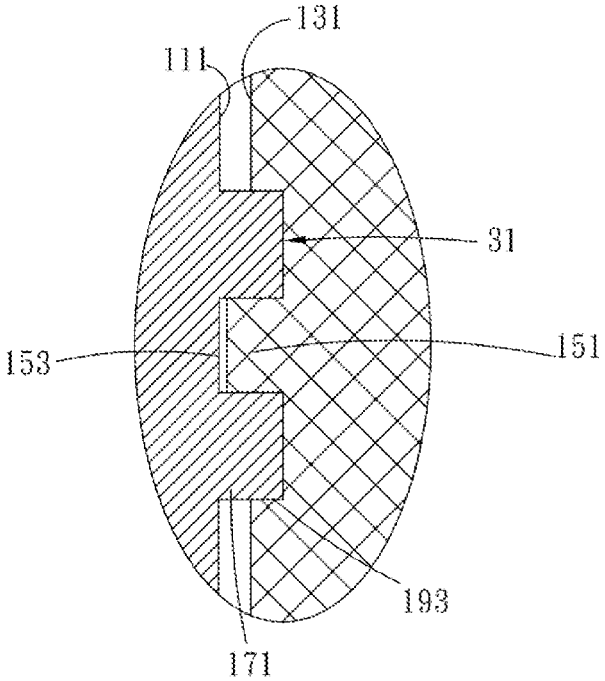
FIG. 18 is a sectional view of the fourteenth embodiment of the supporting mechanism of the present disclosure.

FIG. 18 is a sectional view of the fourteenth embodiment of the supporting mechanism of the present disclosure. The present embodiment differs from the thirteenth embodiment upon the position where the two shafts 151 and the two shaft holes 153 are disposed. In the present embodiment, a shaft hole 153 is disposed on a first protrusion 171 of each of the two first side surfaces 111, and a shaft 151 is disposed on a second recess 193 of each of the two second side surfaces 131. Each of the two shafts 151 is pivotally connected to each of the two shaft holes 153 corresponding to each of the two shafts 151.

Figure 19:
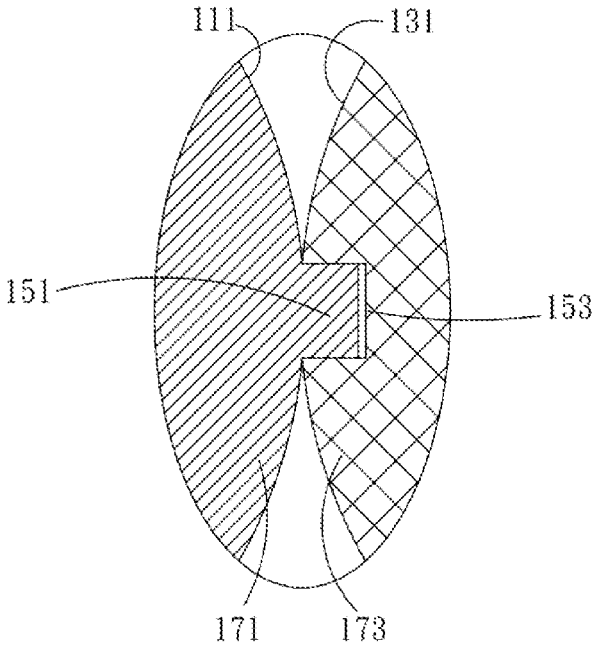
FIG. 19 is a sectional view of the fifteenth embodiment of the supporting mechanism of the present disclosure.

FIG. 19 is a sectional view of the fifteenth embodiment of the supporting mechanism of the present disclosure. As shown in the figure, each of the two smooth surface 31 is an arc surface. In the present embodiment, the surfaces of each of the two first protrusions 171 and each of the two second protrusions 173 corresponding to each of the two first protrusions 171 are arc-shaped, possibly to reduce the size of the contact area of each of the two first side surfaces 111 and each of the second side surfaces 131 corresponding to each of the two first side surfaces 111. The friction between each of the two first side surfaces 111 and each of the second side surfaces 131 corresponding to each of the two first side surfaces 111 can be reduced in this way.

Figure 20:
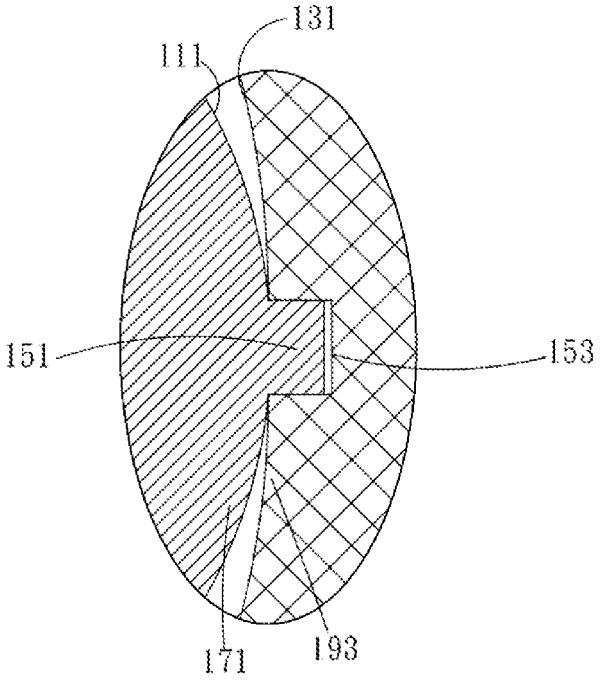
FIG. 20 is a sectional view of the sixteenth embodiment of the supporting mechanism of the present disclosure.

FIG. 20 is a sectional view of the sixteenth embodiment of the supporting mechanism of the present disclosure. The difference between the present embodiment and the thirteenth embodiment is that an outer surface of each of the two first protrusions 171 is an arc surface, and an inner surface of each of the two second recesses 193 is an arc surface.

Both each of the two first side surfaces 111 of the first supporting element 11 and each of the two second side surfaces 131 corresponding to each of the two first side surfaces 111 of the second supporting element 13 have the effect of reducing the noise from rubbing by a smooth surface 31 between each of the two first side surfaces 111 and each of the two second side surfaces 131 corresponding to each of the two first side surfaces 111 in embodiments 1 to 16, so details are not described herein.

Figure 21:
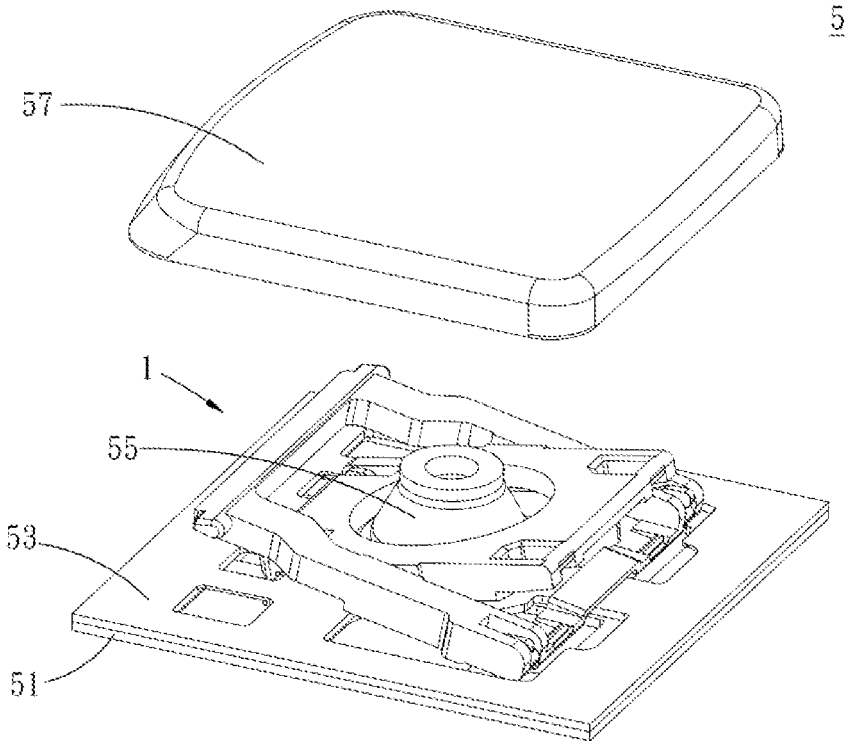
FIG. 21 is an exploded view of the keyswitch of the present disclosure.
Figure 22:
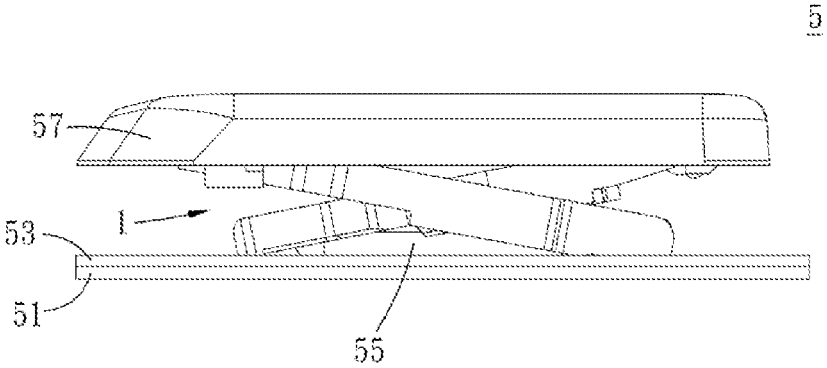
FIG. 22 is a side view of the keyswitch of the present disclosure.

FIG. 21 and FIG. 22 are an exploded view and a side view of the keyswitch of the present disclosure. The present embodiment provides a keyswitch 5 comprising a baseplate 51, a thin film circuit board 53, an elastic body 55, a keycap 57 and a supporting mechanism 1. The thin film circuit board 53 is disposed on the baseplate 51. The elastic body 55 is disposed on the thin film circuit board 53. And the keycap 57 is disposed on the elastic body 55. The keycap 57 disposed on the baseplate 51. The supporting mechanism 1 is disposed between the baseplate 51 and the keycap 57. The top end of the supporting mechanism 1 connects to the keycap 57, and the bottom end of the supporting mechanism 1 connects to the baseplate 51 so that the keycap 57 is able to move up and down relative to the baseplate 51.

Figure 23:
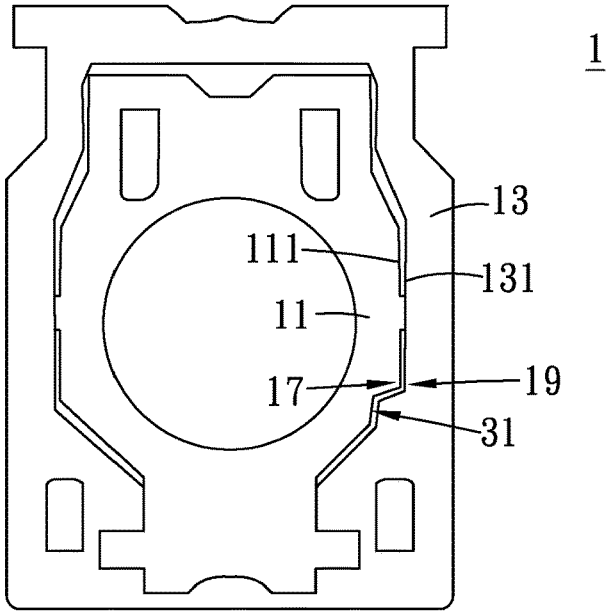
FIG. 23 is an exploded view of the seventeenth embodiment of the supporting mechanism of the present disclosure.

FIG. 23 is an exploded view of the seventeenth embodiment of the supporting mechanism of the present disclosure. The present embodiment differs from the first embodiment upon the first side surface 111 of the first supporting element 11 and the second side surface 131 of the second supporting element 13. In the present embodiment, two protrusions 17 comprise protrusion 17A and protrusion 17B. The two protrusions 17 (17A,17B) are respectively disposed on each of the two first side surfaces 111 of the first supporting element 11, two smooth surfaces 31 are respectively formed on each of the two protrusions 17, and the first connecting parts 113 are respectively disposed on each of the two protrusions 17. The two opposite first side surfaces 111 of the first supporting element 11 are asymmetric or/and the two opposite second side surfaces 131 of the second supporting element 13 are asymmetric. The two opposite second side surfaces 131 of the second supporting element 13 corresponding to each of the two first side surfaces 111. The protrusion 17 protrudes from the middle portion of the first side surface 11 of the first supporting element 11 toward the second supporting element 13. One of the two first side surfaces 111 of the first supporting element 11 has irregular protrusions 17A, and the second side surface 131 of the second supporting element 13 has recesses 19A corresponding to the irregular protrusions 17A.

Figure 24:
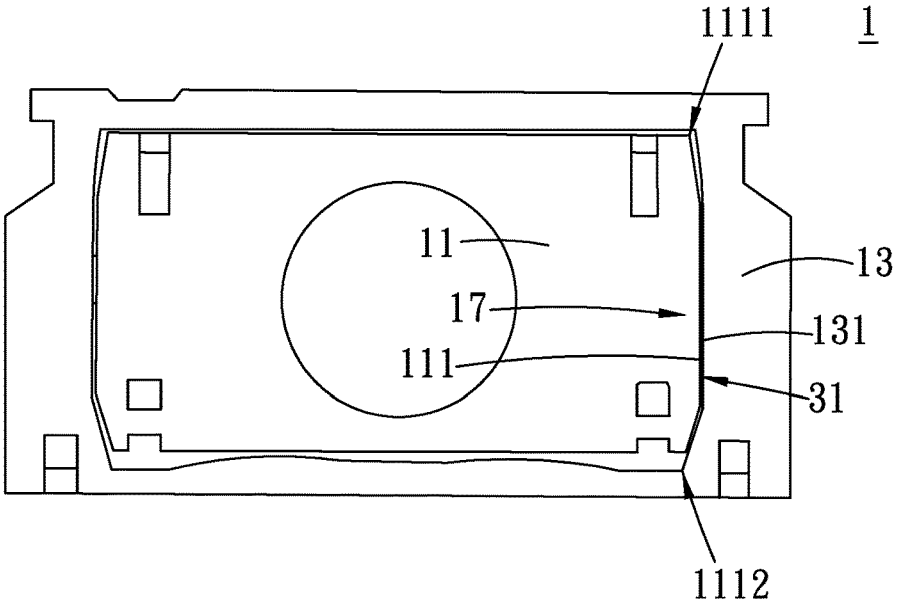
FIG. 24 is an exploded view of the eighteenth embodiment of the supporting mechanism of the present disclosure.

FIG. 24 is an exploded view of the eighteenth embodiment of the supporting mechanism of the present disclosure. The present embodiment differs from the seventeenth embodiment upon the first side surface 111 of the first supporting element 11 and the second side surface 131 of the second supporting element 13. In the present embodiment, the first side surfaces 111 of the first supporting element 11 have protrusions 17. The protrusion 17 protrudes from the first side surface 111 of the first supporting element 11 toward the second side surface 131 of the second supporting element 13, wherein the protrusion 17 is disposed on the entire first side surface 111, and the protrusion 17 in the middle of the first side surface 111 protrudes most toward the second side surface 131. The first side surface 111 has a top end 1111 and a bottom end 1112, the protrusion 17 is an arc surface, and two ends of the arc surface are connected to the top end 1111 and the bottom end 1112.

Figure 25:
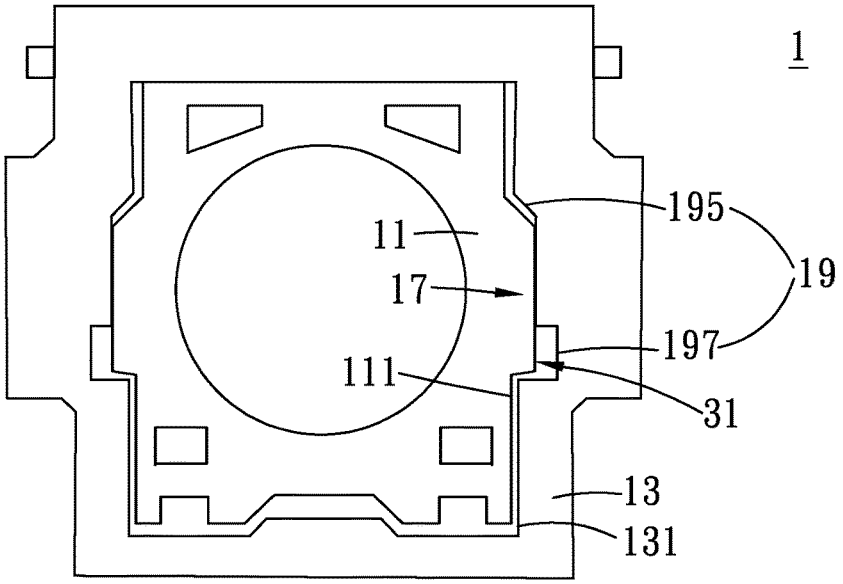
FIG. 25 is an exploded view of the nineteenth embodiment of the supporting mechanism of the present disclosure.

FIG. 25 is an exploded view of the nineteenth embodiment of the supporting mechanism of the present disclosure. The present embodiment differs from the eighteenth embodiment upon the first side surface 111 of the first supporting element 11 and the second side surface 131 of the second supporting element 13. In the present embodiment, the second side surface 131 of the second supporting element 13 has a recess 19 corresponding to the protrusion 17, the recess 19 has a first recess 195 and a second recess 197, the second recess 197 is located at the bottom side of the first recess 195, and the first recess 195 is in communication with the second recess 197. The first side surface 111 of the first supporting element 11 has the protrusion 17 corresponding to the recess 19, and the protrusion 17 is received in the first recess 195.

Figure 26:
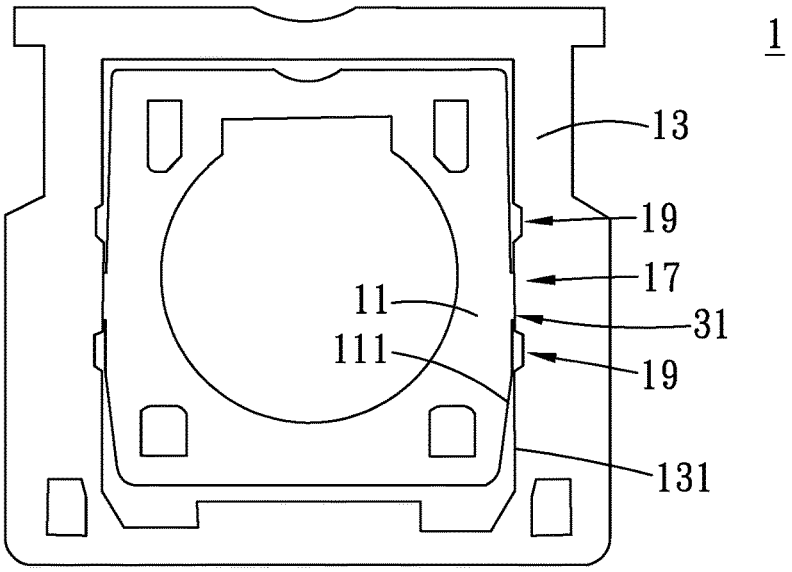
FIG. 26 is an exploded view of the twentieth embodiment of the supporting mechanism of the present disclosure.

FIG. 26 is an exploded view of the twentieth embodiment of the supporting mechanism of the present disclosure. The present embodiment differs from the first embodiment upon the first side surface 111 of the first supporting element 11 and the second side surface 131 of the second supporting element 13. In the present embodiment, two protrusions 17 are respectively disposed on each of the two second side surfaces 131 of the second supporting element 13, two smooth surfaces 31 are respectively formed on each of the two protrusions 17, and the second connecting parts 133 are respectively disposed on each of the two protrusion 17. The second side surface 131 of the second supporting element 13 comprises two recess 19, and the protrusion 17 is disposed between the two recesses 19.

In summary, the present invention proposed a keyswitch. The frictional force produced by rubbing of the first supporting element and the second supporting element can be decreased through the smooth surface so that the noise can be reduced accordingly when the first supporting element and the second supporting element pivot.

It is to be understood that the term "comprises", "comprising", or any other variants thereof, is intended to encompass a non-exclusive inclusion, such that a process, method, article, or device of a series of elements not only include those elements but also includes other elements that are not explicitly listed, or elements that are inherent to such a process, method, article, or device. An element defined by the phrase "comprising a . . . " does not exclude the presence of the same element in the process, method, article, or device that comprises the element.

Although the present invention has been explained in relation to its preferred embodiment, it does not intend to limit the present invention. It will be apparent to those skilled in the art having regard to this present invention that other modifications of the exemplary embodiments beyond those embodiments specifically described here may be made without departing from the spirit of the invention. Accordingly, such modifications are considered within the scope of the invention as limited solely by the appended claims.

What is claimed is:

1. A keyswitch, comprising:

a baseplate;

a keycap disposed on the baseplate; and a supporting mechanism disposed between the keycap and the baseplate, wherein the top end of the supporting mechanism connects to the keycap, and the bottom end of the supporting mechanism connects to the baseplate such that the keycap is able to move up and down relative to the baseplate;

wherein the supporting mechanism comprises a first supporting element, on which two opposite first side surfaces respectively comprise a first connecting part; and a second supporting element, on which two opposite second side surfaces respectively comprise a second connecting part; the first connecting parts are pivotally connected to the corresponding second connecting parts;

wherein two protrusions are respectively disposed on each of the two first side surfaces of the first supporting element, two smooth surfaces are respectively formed on each of the two protrusions, and the first connecting parts are respectively disposed on each of the two protrusions.

2. The keyswitch according to claim 1, wherein the smooth surface is a flat surface or an arc surface.

3. The keyswitch according to claim 1, wherein the first connecting parts are shafts, and the second connecting parts are shaft holes.

4. The keyswitch according to claim 1, wherein the two opposite first sides of the first supporting element or the two opposite second side surfaces of the second supporting element are asymmetric.

5. The keyswitch according to claim 1, wherein the protrusion protrudes from the first side surface of the first supporting element toward the second supporting element.

6. The keyswitch according to claim 1, wherein the protrusion is disposed on the entire first side surface, and the protrusion in the middle of the first side surface protrudes most toward the second side surface.

7. The keyswitch according to claim 1, wherein the first side surface has a top end and a bottom end, the protrusion is an arc surface, and two ends of the arc surface are connected to the top end and the bottom end.

8. The keyswitch according to claim 1, wherein the protrusion protrudes irregularly from the first side surface of the first supporting element toward the second supporting element.

9. The keyswitch according to claim 1, wherein the protrusion protrudes from the middle portion of the first side surface of the first supporting element toward the second supporting element.

10. The keyswitch according to claim 1, wherein the second side surface of the second supporting element has a recess corresponding to the protrusion, the recess has a first recess and a second recess, the second recess is located at the bottom side of the first recess, and the first recess is in communication with the second recess.

11. The keyswitch according to claim 10, wherein the first side surface 111 of the first supporting element has the protrusion corresponding to the recess, and the protrusion is received in the first recess.

12. A keyswitch, comprising:

a baseplate;

a keycap disposed on the baseplate; and a supporting mechanism disposed between the keycap and the baseplate, wherein the top end of the supporting mechanism connects to the keycap, and the bottom end of the supporting mechanism connects to the baseplate such that the keycap is able to move up and down relative to the baseplate;

wherein the supporting mechanism comprises a first supporting element, on which two opposite first side surfaces respectively comprise a first connecting part; and a second supporting element, on which two opposite second side surfaces respectively comprise a second connecting part; the first connecting parts are pivotally connected to the corresponding second connecting parts;

wherein two protrusions are respectively disposed on each of the two second side surfaces of the second supporting element, two smooth surfaces are respectively formed on each of the two protrusions, and the second connecting parts are respectively disposed on each of the two protrusion.

13. The keyswitch according to claim 12, wherein the smooth contact surface is a flat surface or an arc surface.

14. The keyswitch according to claim 12, wherein the first connecting parts are shafts, and the second connecting parts are shaft holes.

15. The keyswitch according to claim 12, wherein the second side surface comprises two recess, and the protrusion is disposed between the two recesses.

16. The keyswitch according to claim 12, wherein the two opposite first sides of the first supporting element or the two opposite second side surfaces of the second supporting element are asymmetric.

* * * * *